United States Patent [19]

Korach

[11] 4,345,986

[45] Aug. 24, 1982

[54] CATHODE ELEMENT FOR SOLID POLYMER ELECTROLYTE

[75] Inventor: Malcolm Korach, Pittsburgh, Pa.

[73] Assignee: PPG Industries, Inc., Pittsburgh, Pa.

[21] Appl. No.: 155,277

[22] Filed: Jun. 2, 1980

[51] Int. Cl.[3] ..... C25B 9/00; C25B 9/04

[52] U.S. Cl. ..... 204/266; 204/283

[58] Field of Search ..... 204/98, 128, 282–283, 204/266

[56] References Cited

U.S. PATENT DOCUMENTS

| | | | |
|---|---|---|---|
| 3,242,059 | 3/1966 | Cottam et al. | 204/98 |
| 4,056,452 | 11/1977 | Campbell | 204/258 |
| 4,057,479 | 11/1977 | Campbell | 204/258 |
| 4,100,050 | 7/1978 | Cook et al. | 204/98 |
| 4,191,618 | 3/1980 | Coker et al. | 204/98 |
| 4,209,368 | 6/1980 | Coker et al. | 204/128 |

FOREIGN PATENT DOCUMENTS

| | | | |
|---|---|---|---|
| 905141 | 9/1962 | United Kingdom | 204/258 |
| 2007267 | 9/1978 | United Kingdom | 204/98 |

*Primary Examiner*—R. L. Andrews

*Attorney, Agent, or Firm*—Richard M. Goldman

[57] ABSTRACT

Disclosed is a solid polymer electrolyte unit, an electrolytic cell containing the unit, and an electrolytic process utilizing the unit. The solid polymer electrolyte unit has anodic and cathodic means contacting opposite surfaces thereof, and is characterized by the structure of the cathode. The cathode removably and compressively bears upon the permionic membrane, and is a microporous, metallic cathode.

4 Claims, 3 Drawing Figures

CATHODE ELEMENT FOR SOLID POLYMER ELECTROLYTE

Solid polymer electrolyte chlor-alkali cells, i.e., for the electrolysis of potassium chloride or sodium chloride brines are characterized by an electrode bearing cation selective permionic membrane separating the anolyte liquor from the catholyte liquor. For example, either the anodic electrocatalyst or the cathodic electrocatalyst, or both may compressively and removably bear upon the permionic membrane, that is, be in contact with, but not physically or chemically bonded to the surfaces of the permionic membrane. Alternatively, either the anodic electrocatalyst or the cathodic electrocatalyst or both may be embedded in or physically or chemically bonded to the permionic membrane.

The commonly assigned co-pending U.S. Application Ser. No. 76,898 filed Sept. 19, 1979 for Solid Polymer Electrolyte Chlor-alkali Process and Electrolytic Cell by William B. Darlington and Donald W. DuBois describes a solid polymer electrolyte chlor-alkali cell where either the anode or the cathode or both compressively bear upon, but are neither embedded in nor bonded to the permionic membrane.

The commonly assigned co-pending U.S. Application Ser. No. 120,217, filed Feb. 11, 1980, for Solid Polymer Electrolyte Chlor-alkali Process and Electrolytic Cell of William B. Darlington and Donald W. DuBois, a continuation-in-part of U.S. Application Ser. No. 76,898, describes a solid polymer electrolyte electrolytic cell where there is no electrolyte gap, that is, no liquid gap between the anodic electrocatalyst which compressively bears upon the anodic surface of the permionic membrane and the membrane, while the cathodic electrocatalyst is bonded to and embedded in the cathodic surface of the permionic membrane.

It is there disclosed that the high current density and low voltage of the solid polymer electrolyte cell are obtained while simple mechanical current collectors and electrode supports are retained on the anolyte side of the cell. However, a solid polymer electrolyte electrolytic cell where the cathodic electrocatalyst is bonded to and embedded in the permionic membrane is subject to high anolyte hydrogen and chlorate, and low current efficiency.

The commonly assigned, co-pending U.S. Application Ser. No. 135,960, filed Mar. 31, 1980, of William B. Darlington, Donald W. DuBois and Preston S. White for Solid Polymer Electrolyte-Cathode Unit attributes the high anolyte hydrogen and chlorate, and the low current efficiency to the formation of hydroxyl ion within the permionic membrane, and describes the importance of avoiding the formation of hydroxyl ion within the permionic membrane.

As there described, a compressive cathode solid polymer electrolyte, i.e., a solid polymer electrolyte where the cathode bears compressively upon the permionic membrane but is neither bonded to nor embedded in the membrane, is characterized by a higher cathodic current efficiency and a lower anolyte $H_2$ content than a conventional solid polymer electrolyte. Conversely, a conventional solid polymer electrolyte, i.e., a solid polymer electrolyte where the cathodic electrocatalyst is bonded to and embedded in the permionic membrane, is characterized by a lower voltage than a compressive cathode solid polymer electrolyte. Accordingly, a particularly desirable solid polymer electrolyte would be one combining the high cathode current efficiency and low anolyte $H_2$ attributes of a compressive cathode solid polymer electrolyte with the low voltage characteristics of a bonded electrode solid polymer electrolyte.

Darlington et al disclose that cathode current efficiency, anolyte $H_2$ content, and to a lesser extent, the anolyte oxygen and chlorate contents are inter-related with the diminished cathode current efficiency and increased anolyte $H_2$ and chlorate of the conventional solid polymer electrolyte relative to the compressive cathode solid polymer electrolyte, both being the result of the electrolytic reaction, $$H_2O + e^- \; OH^- + H_1^0,$$

occurring within the permionic membrane. The inefficiencies are disclosed to be the result of the migration of the hydroxyl ion, formed within the membrane and not being subject to exclusion by the permionic membrane, toward the anode.

Moreover, Darlington et al disclose that the higher voltage of the compressive solid polymer electrolyte over the conventional solid polymer electrolyte is caused by electrolytic conduction of sodium ion within the catholyte liquor, even a thin film of catholyte liquor.

My commonly assigned, co-pending U.S. Application Ser. No. 155,278, for Solid Polymer Electrolyte, filed of even date herewith, describes how the advantages of a conventional, bonded solid polymer electrolyte, e.g., low voltage, as well as the advantages of a compressive solid polymer electrolyte, e.g., high cathode current efficiency and low anolyte $H_2$ content, may be obtained when the cathodic reaction is carried out in a portion of the membrane of reduced cation selectivity on the cathodic side of the membrane separated from the anolyte by a region of increased cation selectivity. As described therein, one particularly desirable solid polymer electrolyte unit may be provided having cathode catalyst particles bonded to and embedded in the permionic membrane, where the cathode electrocatalyst carrying region of the permionic membrane is of lower cation permselectivity than the anodic side of the permionic membrane. As there described, while the evolution of hydroxyl ion within the permionic membrane may not be eliminated, the transport of hydroxyl ion to the anolyte liquor is substantially eliminated. As also described therein, the cathode current efficiency of a solid polymer electrolyte wherein the cathode electrocatalyst removably and compressively bears upon the permionic membrane may be enhanced where the catholyte facing surface or portion of the permionic membrane is of lower cationic selectivity than the anolyte facing surface or portion of the permionic membrane. In both exemplifications, an ion selective means, zone or region of high cation selectivity is interposed between the portion of the membrane in contact with the cathode, and the anolyte. The ion selective means, i.e., the barrier or zone, has a higher cation selectivity than the cathodic portion of the permionic membrane, and is interposed between the cathodic portion of the permionic membrane and the anode means.

It has now been found that high current efficiency of the removable, compressed cathode structure may be retained while avoiding some of the cell voltage penalty associated therewith if the cathode is a microporous metal sheet, compressively bearing upon the permionic membrane. The geometry of the microporous metal sheet should be such as to conform to the permionic membrane, whereby the bulk of the reaction:

$$H_2O + e^- \; OH^- + H$$

occurs at the membrane-cathode-catholyte interface, thereby avoiding electrolytic conduction of anions through the catholyte and evolution of either hydrogen or hydroxyl ion within the permionic membrane. Moreover, the geometry of the microporous sheet should be such as to avoid blocking off, blanking off, or blinding off portions of the permionic membrane, as evidenced by trapping or entraining product between the permionic membrane and the cathode.

THE FIGURES

DETAILED DESCRIPTION

Figure 1:
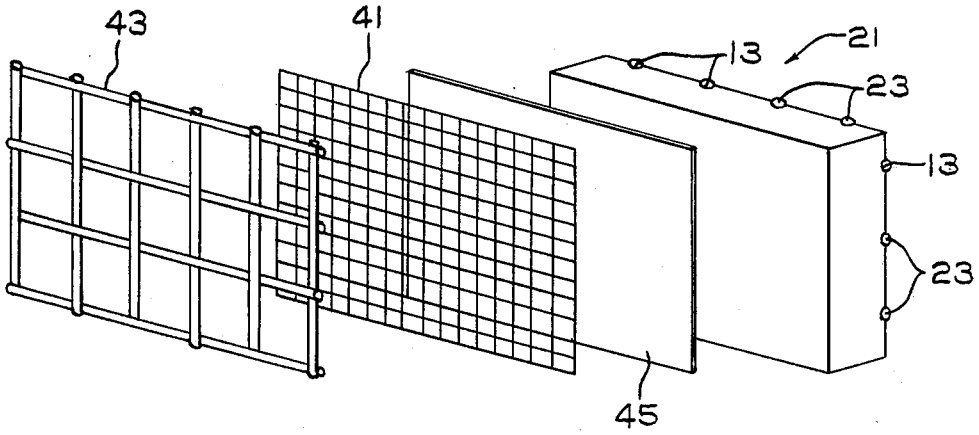
FIG. 1 is an isometric view from the cathodic side of an element of a solid polymer electrolyte having a microporous cathode bearing upon the permionic membrane.
Figure 2:
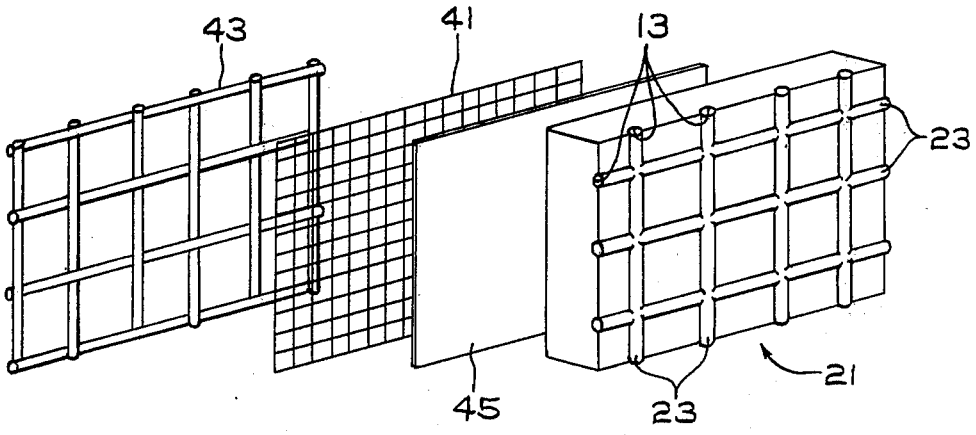
FIG. 2 is an isometric view from the anodic side of an element of the solid polymer electrolyte of FIG. 1 having a microporous cathode sheet bearing upon the permionic membrane.
Figure 3:
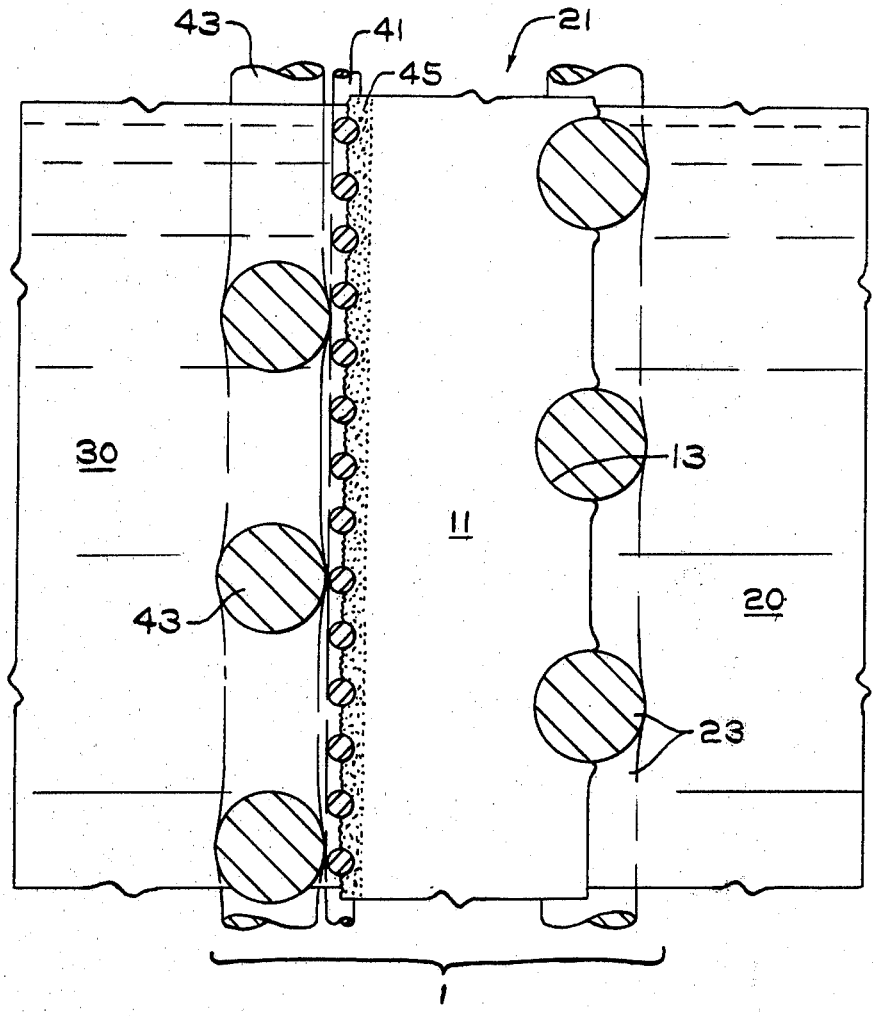
FIG. 3 is a cutaway view of the solid polymer electrolyte of FIGS. 1 and 2 having a microporous cathode bearing upon the permionic membrane.

The chlor-alkali solid polymer electrolyte shown in the Figures has a solid polymer electrolyte unit 1 separating the anolyte liquor from the catholyte liquor. The solid polymer electrolyte unit 1 has a permionic membrane 11 with an anodic unit 21 on the anolyte surface thereof, and a cathodic unit 41 on the catholyte surface thereof. The anodic unit includes anode mesh 23, which bears upon the permionic membrane 11, deforming the anode surface of the permionic membrane 11, as shown for example, in FIG. 3 by anode element deformate 13.

The cathode unit has a microporous cathode element 45 bearing upon the permionic membrane 11. Bearing upon the cathode element 45 are a fine mesh cathode conductor 41 and a coarse mesh cathode conductor 43.

It has now been found that the cathodic energy efficiency, i.e., the product of the cell voltage, the current density, and the cathode current efficiency, is enhanced, at constant anode configuration, anode chemistry and membrane chemistry, the anolyte chlorate content is reduced and the voltage is reduced when the cathode element 45 bearing upon the permionic membrane 11 is a flexible, thin, microporous, metal sheet.

As herein contemplated, the flexible, thin, microporous, metallic sheet cathode element 45 conforms to the permionic membrane 11. In this way the major portion, and preferably substantially all of the reaction:

$$H_2O + e^- \; OH^- + H$$

occurs at the membrane-catholyte-cathode interface, and substantially no hydroxyl ion or hydrogen is evolved either within the catholyte liquor 30 or within the permionic membrane 11. Moreover, the cathode element 45 does not interfere with the free transport of either the hydroxyl ion or the hydrogen evolved at the membrane-catholyte-cathode interface.

This is because the cathode element 45 is thin and porous. The cathode element 45 is less than 2.5 millimeters thick, and preferably less than 1.3 millimeters thick, and preferably from about 0.01 to about 1 millimeter thick but thin enough that it is capable of conforming to the permionic membrane 11.

The porosity of the cathode element 45 is from about 20 percent to about 80 percent. The porosity is defined by the relationship:

$$\text{Porosity} = 1 - \frac{\text{Measured Density}}{\text{Theoretical Density}}.$$

The pores are less than about 0.25 millimeters in diameter, preferably less than about 0.05 millimeters in diameter, and preferably larger than about 0.001 millimeters in diameter.

The cathode element 45 progressively bears upon the permionic membrane 11, so as to conform to the permionic membrane 11 while partially deforming the permionic membrane 11. The imposed pressure on the permionic membrane, as will be described more fully hereinafter, is from about 1 pound per square inch to about 20 pounds per square inch.

The material used in preparing the cathode element is a corrosion resistant metal. In one preferred exemplification it is ductile and malleable, whereby to allow being drawn into a thin sheet, as a foil, and perforated, e.g., by gas jets, liquid jets, electron beam, selective dissolution, photolithography, or the like, or by laser. As herein contemplated, the foil or sheet is fabricated of iron, steel, cobalt, nickel, copper, or a ductile precious metal as silver or gold. The foil or sheet may have an electrocatalytic material on the surface thereof. That is, the surface may contain nickel, porous nickel, graphite, or a catalytic precious metal as a platinum group metal, platinum black, or platinum oxide.

According to an alternative exemplification, the cathode element 45 may be prepared by power metallurgy techniques. That is, the cathode element 45 may be prepared by shaping metal powder to form the cathode element 45. As herein contemplated, metal powder, e.g., mixed powders of nickel and a sacrificial metal, or iron powder, are compacted in the form of the cathode element 45. The resulting green form of the element 45 is then sintered, whereby to form the cathode element 45. Thereafter the sacrificial metal is leached out, whereby to form the porous cathode element 45.

Alternatively, the powder, e.g., iron powder, nickel powder, or nickel powders with powders of a sacrificial metal, may be sintered without compaction, whereby to provide a sintered product of high porosity.

According to a still further exemplification, the cathode element 45 may be a porous coating, film, or layer on the fine mesh 41. For example, a fine screen could be coated with metal powder, metal particles, or the like, e.g., by sintering, chemical deposition, electrodeposition, painting, or the like, and the surface bearing upon the membrane thereafter coated with a suitable catalyst. The resulting composite structure is characterized by having a surface 45, adapted to bear upon the permionic membrane 11, of about 20 percent to 80 percent porosity, with pores of about 0.001 to about 0.025 millimeters in size.

The anode 21, i.e., mesh 23, bears upon the permionic membrane 11, and partially deforms the permionic membrane 11, as shown by deformate 13. The cathode element 45 bears upon and partially deforms the opposite surface of the permionic membrane. The anodic voltage, anode current efficiency, cathode voltage, and cathode current efficiency are believed to be functions of the pressure of the anodic element 21 and cathode element 45 bearing upon the permionic membrane 11. Thus, it has been found that the voltage initially decreases with increasing pressure, that is, with increasing compression of the permionic membrane 11 between the anodic mesh 23 and the cathode element 45. Thereafter, the rate of voltage decrease with increasing pressure diminishes and, ultimately, a constant voltage is attained, which voltage is substantially independent of increasing pressure. The pressure at which substantially constant voltage versus pressure is attained is also a function of the geometry of the mesh 23, i.e., orientation of the openings, solid material thickness, size and openings, percent open area, electrode materials of construction, electrode material resiliency, and openings per unit area.

The pressure-voltage relationship is a function of the resiliency and elasticity of the cathode current conductors 41 and 43, the cathode catalyst element 45, and of the anode substrate 23, as well as the resiliency and elasticity of the permionic membrane 11, the geometry of the anode substrate 23 and the cathode current collectors 41 and 43, and cathode element 45, the size of the individual substrate and current collector elements, the internal reinforcement of the permionic membrane 11, the thickness of the permionic membrane 11, and the materials of construction of the electrode elements.

For any electrode-permionic membrane combination, the determination of a satisfactory pressure, that is, a pressure at which increasing imposed pressures give no significant decrease in voltage, is a matter of routine experimentation.

For unreinforced Asahi Glass Flemion (TM) carboxylic acid membranes, where the anode substrate 23 is of eight to ten strands per inch of 1 millimeter diameter titanium and the fine cathode current collector 41 has forty to sixty percent open area and about 200 to 300 openings per square centimeter, and is steel or nickel, compressive pressures between the cathode current collector 41 and the anode substrate 23 of from at least one pound per square inch, up to about 20 pounds per square inch yield voltage reductions.

The anode substrate 23, and the cathode current collectors 41 and 43, are preferably fine mesh having a high percentage of open area, e.g., above about 40 percent open area to about 80 percent open area, and a narrow pitch, e.g., about 0.1 to 2 millimeters between individual elements thereof. Suitable anode substrates 23, and cathode current collectors 41 and 43, have about 10 to 60 strands per inch, where the individual strands are from about 0.5 to about 2.5 millimeters apart, center line to center line, and a diameter such as to provide at least 40 percent open area, preferably 60 to 80 percent open area, and from about 15 to about 600 openings per square centimeter.

The permionic membrane 11 should be chemically resistant, cation selective, with anodic chlorine evolution catalyst 23 bearing upon, or bonded to, or bonded to and embedded in the anodic surface and cathodic catalyst element 45 compressively bearing thereon.

The fluorocarbon resin permionic membrane 11 used in providing the solid polymer electrolyte 1 is characterized by the presence of cation selective ion exchange groups, the ion exchange capacity of the membrane, and the glass transition temperature of the membrane material.

The fluorocarbon resins herein contemplated have the moieties:

$$\text{-}(CF_2\text{-}CXX')\text{-}\ \text{and}$$

$$\text{-}(CF_2\text{-}\underset{\underset{Y}{|}}{C}\text{-}X)\text{-}$$

where X is —F, —Cl, —H, or $-CF_3$; X' is —F, —Cl, —H, $-CF_3$ or $CF_3(CF_2)_m$—; m is an integer of 1 to 5; and Y is —A, —3—A, —P—A, or $-O-(CF_2)_n$ (P, Q, R)—A.

In the unit (P, Q, R), P is $-(CF_2)_a(CXX')_b(CF_2)_c$, Q is $\text{-}(CF_2\text{-}O\text{-}CXX')_d$, R is $(-CXX'O-CF_2)_e$ and (P, Q, R) contains one or more of P, Q, R, and is a discretionary grouping thereof.

$\phi$ is the phenylene group; n is 0 or 1; a, b, c, d and e are integers from 0 to 6.

The typical groups of Y have the structure with the acid group A, connected to a carbon atom which is connected to a fluorine atom. These include $(CF_2)$ A, and side chains having ether linkages such as:

$$-O\text{-}(CF_2)_xA,\ \text{-}(O-CF_2-\underset{\underset{Z}{|}}{CF})_yA,$$

$$\text{-}(O-CF_2-\underset{\underset{Z}{|}}{CF})_x\text{-}(O-CF_2-CF_2)_yA,\ \text{and}$$

$$-O-CF_2\text{-}(CF_2-O-\underset{\underset{Z}{|}}{CF})_x\text{-}(CF_2)_y(CF_2-O-\underset{\underset{R}{|}}{CF})_zA,$$

where x, y and z are respectively 1 to 10; Z and R are respectively —F or a $C_{1-10}$ perfluoroalkyl group, and A is the acid group as defined below.

In the case of copolymers having the olefinic and olefin-acid moieties above described, it is preferable to have 1 to 40 mole percent, and preferably especially 3 to 20 mole percent of the olefin-acid moiety units in order to produce a membrane having an ion-exchange capacity within the desired range.

A is an acid group chosen from the group consisting of:

$-SO_3H$
—COOH
$-PO_3H_2$, and
$-PO_2H_2$, or a group which may be converted to one of the aforesaid groups by hydrolysis or by neutralization. Whenever a completed, assembled solid polymer electrolyte installed in an electrolytic cell is referred to as being in the acid form it is to be understood that the alkali salt form is also contemplated.

In one exemplification, A may be either $-SO_3H$ or a functional group which can be converted to $-SO_3H$ by hydrolysis or neutralization, or formed from $-SO_3H$ such as $-SO_3M'$, $(SO_2-NH)$ M'', $-SO_2NH-R_1-NH_2$, or $-SO_2NR_4R_5NR_4R_6$; M' is an alkali metal; M'' is H, $NH_4$, an alkali metal, or an alkaline earth metal; $R_4$ is H, Na or K; $R_3$ is a $C_3$ to $C_6$ alkyl group, $(R_1)_2$ $NR_6$, or $R_1NR_6$ $(R_2)_2NR_6$; $R_6$ is H, Na, K or $-SO_2$; and $R_1$ is a $C_2$–$C_6$ alkyl group.

In a particularly preferred exemplification of this invention, A may be either —COOH, or a functional group which can be converted to —COOH by hydrolysis or neutralization such as —CN, —COF, —COCl, —COOR, —COOM, $-CONR_2R_3$; $R_1$ is a $C_{1-10}$ alkyl group and $R_2$ and $R_3$ are either hydrogen or $C_1$ to $C_{10}$ alkyl groups, including perfluoralkyl groups, or both. M is hydrogen or an alkali metal; when M is an alkali metal it is most preferably sodium or potassium.

Cation selective permionic membranes where A is either —COOH, or a functional group derivable from or convertible to —COOH, e.g., —CN, —COF, COCl, —$COOR_1$, —COOM, or —$CONR_2R_3$, as described above, are especially preferred because of their voltage advantage over sulfonyl membranes. This voltage advantage is on the order of about 0.1 to 0.4 volt at a current density of 150 to 250 amperes per square foot, a brine content of 150 to 300 grams per liter of sodium chloride, and a caustic soda content of 15 to 50 percent percent sodium hydroxide. Additionally, the carboxylic acid type membranes have a current efficiency advantage over sulfonyl type membranes.

The membrane materials useful in the solid polymer electrolyte herein contemplated have an ion exchange capacity of from about 0.5 to about 2.0 milligram equivalents per gram of dry polymer, and preferably from about 0.9 to about 1.8 milligram equivalents per gram of dry polymer, and in a particularly preferred exemplification, from about 1.1 to about 1.7 milligram equivalents per gram of dry polymer. When the ion exchange capacity is less than about 0.5 milligram equivalents per gram of dry polymer, the voltage is high at the high concentrations of alkali metal hydroxide herein contemplated, while when the ion exchange capacity is greater than about 2.0 milligram equivalents per gram of dry polymer, the current efficiency of the membrane is too low.

The content of ion exchange groups per gram of absorbed water is from about 8 milligram equivalents per gram of absorbed water to about 30 milligram equivalents per gram of absorbed water, and preferably from about 10 milligram equivalents per gram of absorbed water to about 28 milligram equivalents per gram of absorbed water, and in a preferred exemplification, of about 14 milligram equivalents per gram of absorbed water to about 26 milligram equivalents per gram of absorbed water. When the content of ion exchange groups per unit weight of absorbed water is less than about 8 milligram equivalents per gram the voltage is too high, and when it is above about 30 milligram equivalents per gram, the current efficiency is too low.

The glass transition temperature is preferably at least about 20° C. below the temperature of the electrolyte. When the electrolyte temperature is between about 95° C. and 110° C., the glass transition temperature of the fluorocarbon resin permionic membrane material is below about 90° C., and in a particularly preferred exemplification, below about 70° C. However, the glass transition temperature should be above about −80° C. in order to provide satisfactory tensile strength of the membrane material. Preferably the glass transition temperature is from about −80° C. to about 70° C., and in a particularly preferred exemplification, from about −80° C. to about 50° C.

When the glass transition temperature of the membrane is within about 20° C. of the electrolyte or higher than the temperature of the electrolyte, the resistance of the membrane increases and the permselectivity of the membrane decreases. By glass transition temperature is meant the temperature below which the polymer segments are not energetic enough to either move past one another or with respect to one another by segmental Brownian motion. That is, below the glass transition temperature, the only reversible response of the polymer to stresses is strain, while above the glass transition temperature the response of the polymer to stress is segmental rearrangement to relieve the externally applied stress.

The fluorocarbon resin permionic membrane materials contemplated herein have a water permeability of less than about 100 milliliters per hour per square meter at 60° C. in four normal sodium chloride at a pH of 10 and preferably lower than 10 milliliters per hour per square meter at 60° C. in four normal sodium chloride of the pH of 1. Water permeabilities higher than about 100 milliliters per hour per square meter, measured as described above, may result in an impure alkali metal hydroxide product.

The electrical resistance of the dry membrane should be from about 0.5 to about 10 ohms per square centimeter and preferably from about 0.5 to about 7 ohms per square centimeter.

The thickness of the permionic membrane 11 should be such as to provide a membrane 11 that is strong enough to withstand pressure transients and manufacturing processes, but thin enough to avoid high electrical resistivity. The membrane is from 10 to 1000 microns thick and, in a preferred exemplification, from about 50 to about 400 microns thick. Additionally, internal reinforcement, or increased thickness, or crosslinking, or even lamination may be utilized whereby to provide a strong membrane.

According to a particularly desirable alternative exemplification, the cathodic side of the permionic membrane 11 may be separated from the anolyte by a region within the permionic membrane 11 of higher cation selectivity. That is, the region of the permionic membrane 11 in contact with the cathodic element 45 may be of low cation selectivity, and a region of higher cation selectivity may be interposed between said low selectivity region and the anolyte. In this way, as described in my commonly assigned, co-pending U.S. Application Ser. No. 155,278, for Solid Polymer Electrolyte, filed of even date herewith, and the disclosure of which is incorporated herein by reference, the transport through the permionic membrane 11 of hydroxyl ions inadvertantly formed within the membrane 11 is reduced, or even eliminated.

According to one preferred exemplification of this invention, the solid polymer electrolyte unit 1 consists of a permionic membrane 11 from about 10 to about 1000 microns thick, having an anode element 21 of anode mesh 23 of from 6 to 20 strands of about one millimeter diameter ruthenium dioxide-titanium dioxide coated titanium mesh per inch, and the cathode element 45 is a 0.05 millimeter thick porous foil having pores of 0.001 to 0.025 millimeter diameter, and a porosity of 20 to 80 percent. Preferably the cathode element 45 is nickel. The cathode current carriers 41 and 43, and the anode substrate 21 provide compressive pressures of about 1 pound per square inch up to about 20 pounds per square inch.

The solid polymer electrolyte prepared as described above may be used at high current densities, for example, in excess of 200 amperes per square foot. Thus, according to a particularly preferred exemplification, electrolysis may be carried out at a current density of 800 or even 1200 amperes per square foot, where the current density is defined as the total current passing through the cell divided by the surface area of one side of the permionic membrane 11.

While this invention has been described in terms of specific details and embodiments, the description is not intended to limit the invention, the scope of which is as defined in the claims appended hereto.

I claim:

1. In an electrolytic cell having an electrolyte impermeable permionic membrane with an anodic portion and a cathodic portion, anodic means removably in contact with the anodic portion, and cathodic means removably in contact with and compressively bearing upon the cathodic portion, the improvement wherein the cathodic means removably bearing upon the permionic membrane comprises a microporous, ductile member, consisting essentially of metallic materials, having a thickness of from about 0.01 millimeter to 1.0 millimeter, chosen from the group consisting of perforated foils and perforated sheets, and conforming to the permionic membrane.

2. The electrolytic cell of claim 1 wherein the cathode means bearing upon the permionic membrane comprises a metal sheet having pores less than 0.25 millimeters in diameter, and a porosity of from about 20 to about 80 percent.

3. The electrolytic cell of claim 1 wherein the cation selectivity of the anodic portion of the permionic membrane is higher than the cation selectivity of the cathodic portion of the permionic membrane.

4. In an electrolytic cell having an electrolyte impermeable permionic membrane with an anodic portion and a cathodic portion, anodic means removably in contact with the anodic portion, and cathodic means removably in contact with and compressively bearing upon the cathodic portion, the improvement wherein the cathodic means removably bearing upon the permionic membrane comprises a microporous, ductile member, consisting essentially of sintered metallic materials, having a thickness of from about 0.01 millimeter to 1.0 millimeter, and conforming to the permionic membrane.

* * * * *